United States Patent [19]

Schallenkammer

[11] 3,983,386

[45] Sept. 28, 1976

[54] SWING ARM LAMP

[76] Inventor: Fred Schallenkammer, 107-18 101st Ave., Ozone Park, N.Y. 11416

[22] Filed: May 7, 1975

[21] Appl. No.: 575,242

[52] U.S. Cl. ..... 240/81 R
[51] Int. Cl.[2] ..... F21S 1/12
[58] Field of Search ..... 240/81 R, 81 BC, 81 BD, 240/81 BE, 73 BJ

[56] References Cited

UNITED STATES PATENTS

| | | | |
|---|---|---|---|
| 2,244,298 | 6/1941 | Icove | 240/81 |
| 2,618,739 | 11/1952 | Fleishman | 240/81 R |
| 2,634,073 | 4/1953 | Mason | 240/81 R |

*Primary Examiner*—Monroe H. Hayes

[57] ABSTRACT

My invention relates to an improvement in a lamp structure of a type generally referred to as a swing arm lamp where a shaded electric lighting unit is attached to the end of an arm horizontally extending from a lamp post and pivotally swung about said post in a horizontal arc.

1 Claim, 8 Drawing Figures

SWING ARM LAMP

The object of my invention is to provide a lamp structure whose shaded electric lighting unit can be swung in a horizontal plane to almost any point within a circular area by combining a primary horizontal swing action pivoting about said lamp post and a secondary horizontal independent swing action pivoting about a swivel interconnecting a linkage of horizontal swing arms.

I attain these objects by mechanism illustrated in the accompanying drawings

Similar numbers refer to similar parts thru out the various views.

Figures 1, 2, 3, 4, 5, 6, 7, 8:
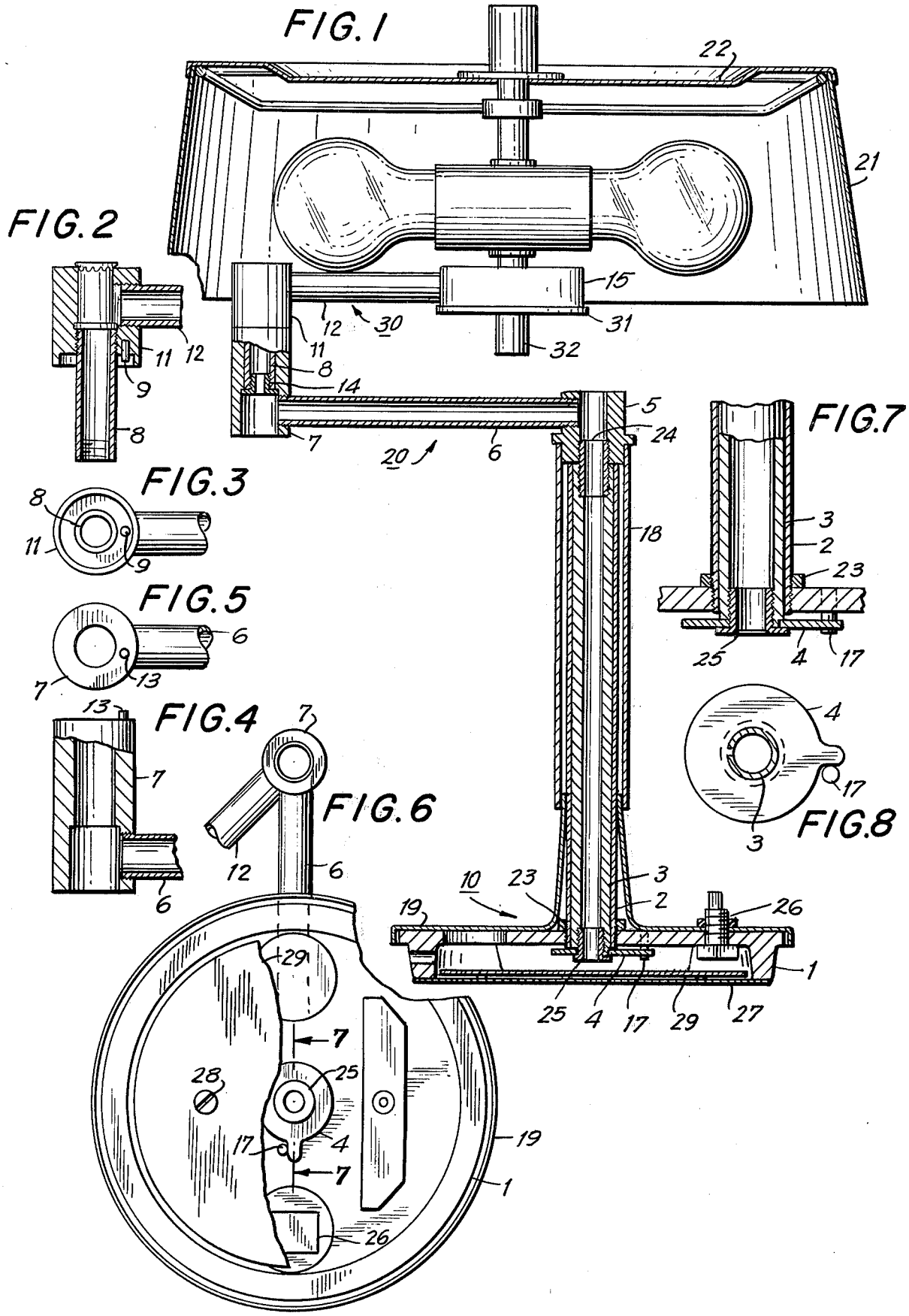
FIG. 1 is a vertical section of the entire lamp showing the horizontal swing arms in a folded-up position.
FIG. 2 is a vertical section of the top rotating swivel portion or the swivel assembly.
FIG. 3 is a bottom plan view of said swivel portion.
FIG. 4 is a vertical section of the bottom portion of said swivel.
FIG. 5 is a plan view of the bottom portion of said swivel.
FIG. 6 is a partial bottom view of the lamp base assembly with the bottom closure plate removed and showing the lower swing arm in zero position against a stop pin and the upper swing arm slightly swung out.
FIG. 7 is a vertical section on the line 7—7 of the lamp post assembly showing its connection to the lamp base.
FIG. 8 is a fragmentary bottom view of FIG. 7.

A lamp base unit 10 comprising a heavy lamp base 1 having a tapped hole thru its center into which is screwed and secured by a locknut 23 a round tubular stem 2 which protrudes slightly into the bottom recess of said lamp base 1 and extending vertically upward, said tubular stem 2 having a uniform inside diameter thru out its entire length to serve as a sleeve bearing for an inner tube 3 which rotates within it and serves as a support and electrical wire chase for the entire horizontal swing arm linkage assembly branching from a cap 5 fastened to the top end of said inner tube 3 by means of a threaded nipple 24. Said inner tube 3 resting with said cap 5 on the open top end of said tubular stem 2, said inner tube 3 having a shoulder recess turned on its bottom end which protrudes slightly beyond the bottom end of said tubular stem 2 when assembled together and by having a lug washer 4 fastened to said shoulder recess, said inner tube 3 will be retained in said lamp base unit 10 to rotate freely with a minimum of end play.

Said lug washer 4 is keyed or staked to said shoulder recess at the bottom end of said inner tube 3 to prevent radial shift and is fastened thereto by a flanged nipple 25. From said cap 5 extends horizontally a tubular arm 6 terminating in the bottom portion 7 of a swivel which has a hole thru its center serving as a sleeve bearing for a tubular stem 8 extending from the top portion 11 of said swivel whose rotation is confined to less than one revolution by means of stop pins 9 and 13 mounted on the joint faces. One of said stop pins 9 is mounted on the top face of said bottom portion 7 of said swivel and extends into a annular groove at the bottom face of said rotating swivel portion 11 where it engages a pin 13 mounted in said groove for a positive stop of rotation. Said pin 13 is so located in relation to the linkage swing arms 6 and 12 that on clockwise rotation of said swivel portion 11 a stop will be effected when the upper swing arm 12 extending from said rotating swivel portion 11 will be parallel and directly above said lower swing arm 6. said top swivel portion 11 and said bottom swivel portion 7 are held together on assembly by a flanged nipple 14 screwed into the tapped bottom end of said tubular stem 8 which protrudes slightly into a counter bored recess in the bottom portion of said swivel 7 allowing for free rotation with little end play. Said recess is deep enough to accomodate the necessary electric wiring. The lighting unit assembly 30 incorporates said independent swing arrangement pivoting about said rotating swivel portion 11 from which extends said upper swing arm 12 and which terminates in a shallow inverted drum-like box 15 which serves as a housing for the required intermediate electric wire connections and also supports the shade assembly consisting of a shallow round shade 21 of large enough bottom diameter to cover up part of the swivel 11 and upper swing arm 12, a diffuser disc 22 for the top of said shade 21 a bottom closure disc 31 for box 15, a handknob 32 also standard electric light bulbs and socket cluster and other commerically obtainable components not specifically listed. Said lug washer 4 having a lug protruding from its circular body which will on counter clockwise rotation of said inner tube 3 contact a stop pin 17 mounted on said bottom recess of said lamp base 1 for a positive stop when the swing arms 6 and 12 are folded up and extending toward the rear of the lamp base 1 away from the switch as shown in FIG. 1 of the drawings for proper swing operation the direction of rotation of said inner tube 3 must be the opposite of the direction of rotation of said top swivel portion 11.

To said cap 5 is fastened a tubular handle 18 which is open at its bottom end and is extending cantilever fashion downward and amply clearng on rotation said stationary tubular stem 2 while rotating in unison with the inner tube 3. Only said lamp base unit 10 will remain stationary during swing opeation. Lifting the lamp by said handle 18 will arrest the swing action of the central swing unit assembly 20 pivoting about said lamp stem 2 and consisting in addition to said handle 18 also of said inner tube 3 said cap 5 said lower swing arm 6 and including said bottom swivel portion 7. Only said lighting unit assembly 30 pivoting independently about said rotating swivel portion 11 is free to swing when lifting the lamp by said handle 18. A sheet metal cover 19 will be applied to the lamp base 1 and a closure disc 29 for protecting the electrical wire connections is fastened to the bottom of said lamp base 1 with two flat head screws 28 and a felt pad cover 27 applied. The open end at the top and bottom swivel portions 11 and 7, also said cap 5 are plugged up with removable commercial snap-on hole buttons after the lamp is wired. A standard electrical fixture switch 26 is provided for the base 1.

What is claimed is:

1. In a combination swing arm lamp structure a round tubular stem extending vertically upward from a heavy base and protruding slightly into a recess at the bottom of said base; said stem serving as a sleeve bearing for an inner tube rotating within it and resting with a cap fastened to its top end on the open top end of said tubular stem and said cap supporting the entire swing arm linkage branching horizontally from it; said inner tube extending thru the entire length of said tubular stem and having a shoulder recess turned on its bottom end which protrudes slightly beyond the bottom end of said tubular stem when assembled together, and having a lug washer fastened to said shoulder recess; said lug washer having a protruding lug engaging on counter clockwise rotation, a stop pin in the bottom recess of said lamp base when the swing arms are folded up and extending toward the rear; said swing arm linkage comprising a tubular arm extending horizontally from said cap and terminating in the bottom portion of a swivel having a hole thru its center serving as a sleeve bearing for a tubular stem extending from the rotating top portion of said swivel whose rotation is confined to less than one revolution by means of stop pins mounted on the joint faces; one of said stop pins being mounted on the top face of said fixed bottom portion of said swivel and extending into an annular recess at the bottom face of said rotating top portion of said swivel where it engages a pin mounted in said recess for a positive stop of rotation; from said rotating top portion of said swivel extending horizontally, a tubular arm which terminates in a shallow drum-shaped box for intermediate electrical wire connections, said connection box also supporting the shaded lighting unit mounted to its top face; the location of said stop pins in the swivel in relation to the swing arm linkage being such that on clockwise rotation of said swivel a stop to the swing action is effected when the lower and upper swing arms are folded in closed position, that is, one above the other, the top and bottom portions of said swivel being held together with a minimum of end play by a flanged nipple screwed into the bottom end of said rotating tubular stem; for proper swing operation the direction of rotation of said inner tube of the lamp post being the opposite of the direction of rotation of said swivel portion; fastened to said cap connected to the top end of said inner tube a tubular handle which is open at its bottom end and extends downward amply clearing on rotation said tubular stem which extends upward from said stationary lamp base; said handle, said cap and said inner tube being fastened together for rotating in unison when swinging said interconnected lower swing arm, lifting the lamp by said handle arresting the primary swing action pivotally about said lamp stem permitting only said shaded lighting unit to be swung pivotally about said swivel thus preventing any uncontrollable flapping about of the swing arm linkage.

* * * * *